US008359163B2

(12) United States Patent
Bowen

(10) Patent No.: US 8,359,163 B2
(45) Date of Patent: Jan. 22, 2013

(54) ESTIMATING FLUID FLOW IN A RESERVOIR

(75) Inventor: Garfield Bowen, Brightwell-cum-Sotwell (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 431 days.

(21) Appl. No.: 12/634,773

(22) Filed: Dec. 10, 2009

(65) Prior Publication Data

US 2010/0305866 A1 Dec. 2, 2010

Related U.S. Application Data

(60) Provisional application No. 61/182,837, filed on Jun. 1, 2009.

(51) Int. Cl.
*G01V 1/40* (2006.01)

(52) U.S. Cl. ..... 702/13

(58) Field of Classification Search ..... 702/13
See application file for complete search history.

(56) References Cited

U.S. PATENT DOCUMENTS

| | | | | |
|---|---|---|---|---|
| 6,052,520 | A * | 4/2000 | Watts, III | 703/10 |
| 6,766,255 | B2 | 7/2004 | Stone | |
| 7,089,167 | B2 | 8/2006 | Poe | |
| 7,177,764 | B2 | 2/2007 | Stone | |
| 7,523,647 | B2 * | 4/2009 | Scott | 73/61.44 |
| 2002/0016703 | A1 * | 2/2002 | Barroux | 703/10 |
| 2002/0143479 | A1 * | 10/2002 | Fukuhara | 702/45 |
| 2008/0208539 | A1 * | 8/2008 | Lee et al. | 703/1 |

* cited by examiner

*Primary Examiner* — Cindy H Khuu

(57) ABSTRACT

The present disclosure relates to a method to improve the performance of reservoir simulators, and to widen the range of systems that can efficiently be modeled. The present disclosure relates to determining fluid flow in a subsurface reservoir. One embodiment divides the reservoir into discrete volume elements. Fluid within the volume elements is represented, for example, by it pressure, saturation, and/or composition. For one or more fluid phases comprising the fluid, the potential for each volume element is determined. The volume elements are ordered according to their potentials for each phase comprising the fluid. A local, fully coupled time-step sequence is determined using a local conservation solution based on the potential ordering of and for each fluid phase. The fluid flow is determined using a global conservation solution based on the local, fully coupled time-step sequence.

19 Claims, 4 Drawing Sheets

ESTIMATING FLUID FLOW IN A RESERVOIR

CROSS-REFERENCE TO OTHER APPLICATIONS

This application claims priority to and the benefit of U.S. Provisional Application No. 61/182,837, filed Jun. 1, 2009.

BACKGROUND

Oil and gas reservoirs are accumulations of hydrocarbons trapped within the earth's crust. The hydrocarbons exist as fluids within the pore space of porous rocks. If flow of the fluid is possible, then the accumulation may be an exploitable reservoir. The reservoir is typically produced by drilling wells into the appropriate formation to allow flow through the porous rock towards and into a producing well, and ultimately to the surface.

When considering investment decisions and day-to-day operations, reservoir engineers would like to be able to predict the hydrocarbon recovery, given certain assumptions about the reservoir, production system, and operating conditions. Historically, this has been achieved using simple analytic models, but since the advent of the computer, engineers have simulated the subsurface formation and fluid flow using numerical methods.

The computer programs used to do those simulations are usually referred to as reservoir simulators. Different reservoir simulators may use different numerical techniques, and may make different physical assumptions, but all aim to solve equations describing the flow within the reservoir to provide predictions of the fluid movement. Often the simulations will use significant computer resources and take considerable time to run.

Reservoir simulators since the 1960s have discretized the reservoir into grid blocks representing small regions of space. Such simulators are known as finite volume models. For such models, fluid is assumed to be conserved for each grid block. Typically, the pressure is solved for implicitly, while the saturations or concentration variables that describe the composition of the fluid in a grid block may be solved explicitly or implicitly.

SUMMARY

The present disclosure relates to a method to improve the performance of reservoir simulators, and to widen the range of systems that can efficiently be modeled. The present disclosure relates to determining fluid flow in a subsurface reservoir. One embodiment divides the reservoir into discrete volume elements. Fluid within the volume elements is represented, for example, by it pressure, saturation, and/or composition. For one or more fluid phases comprising the fluid, the potential for each volume element is determined. The volume elements are ordered according to their potentials for each phase comprising the fluid. A local, fully coupled time-step sequence is determined using a local conservation solution based on the potential ordering of and for each fluid phase. The fluid flow is determined using a global conservation solution based on the local, fully coupled time-step sequence.

This summary is provided to introduce a selection of concepts that are further described below in the detailed description. This summary is not intended to identify key or essential features of the claimed subject matter, nor is it intended to be used as an aid in limiting the scope of the claimed subject matter.

It is to be understood that the drawings are to be used for the purpose of illustration only, and not as a definition of the metes and bounds of the invention, the scope of which is to be determined only by the scope of the appended claims.

DETAILED DESCRIPTION

Specific embodiments will now be described with reference to the figures. Like elements in the various figures will be referenced with like numbers for consistency. In the following description, numerous details are set forth to provide an understanding of the disclosed subject matter. However, it will be understood by those skilled in the art that many embodiments may be practiced without many of those details and that numerous variations or modifications from the described embodiments are possible.

Figure 1:
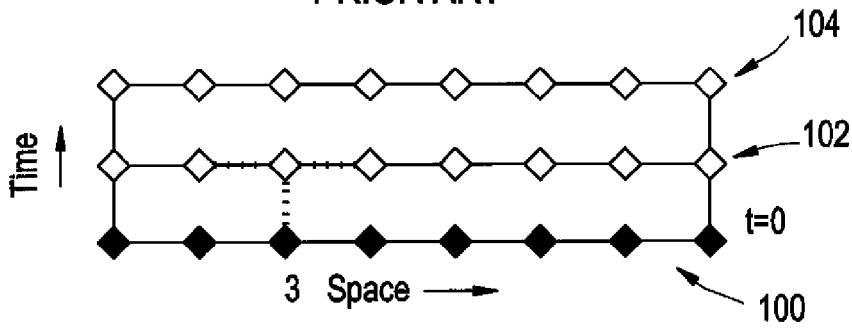
FIG. 1 PRIOR ART
FIG. 1 is a schematic illustration representing a traditional, fully implicit simulation, as known in the prior art.

A traditional, fully implicit simulation can be represented in a schematic way as illustrated in FIG. 1. The x-axis represents space, and the y-axis time. The diamond symbols represent the discretized variables for which a solution is sought. A given grid block's solution in time is represented as a discrete set of diamond symbols running vertically up the diagram.

An initial set of variables is assumed to be known, and is represented in FIG. 1 as a row (i.e., the bottom row) of darkened diamonds 100. The initial set of known variables may, for example, be the initial state of the system (i.e., variable values at a given time) or a computed solution from a previously solved time-step. For the time-step under consideration in the particular example of FIG. 1, the unknowns system variables at some future time are symbolized by the middle row of open diamonds 102. Once those unknown system variables are determined, the solution method moves to the next time-step, represented as the upper row of open diamonds 104, and determines the system variable values at that time. This methodology is repeated until a final time is reached.

The residual of the solution for a given unknown at some advanced time will typically depend on its neighboring grid blocks at that advanced time and its own grid block at the previous time-step. This interdependence is schematically shown for block 3 as dotted lines in FIG. 1.

Figure 2:
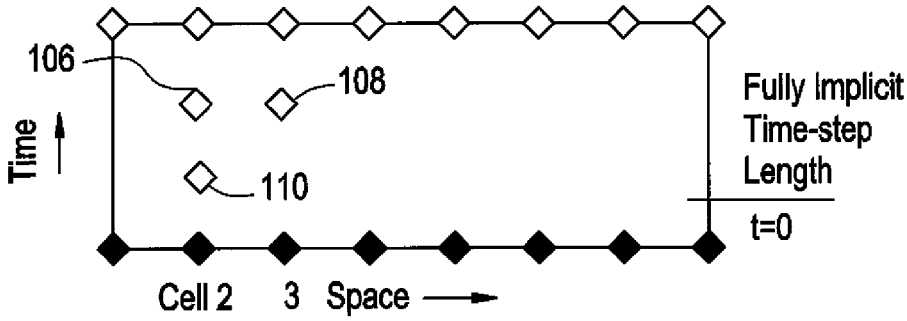
FIG. 2 is a schematic illustration showing different time-steps being used for different cells (grid blocks), in accordance with the present disclosure.

Because one is not always interested in the calculated solution at intermediate times, the system can be more efficiently solved using discretized approximations that provide a fully coupled (implicit) solution, but which allow significantly larger time-steps to be used without having to calculate the intermediate time solutions for most of the field. Small time-steps are used locally in space such that the transport phenomena are accurately described where they are changing, but large time-steps are used in those parts of space where the transport phenomena are constant or changing very slowly. The use of larger time-steps is illustrated in FIG. 2. For comparison, the corresponding fully implicit time-step from FIG. 1 is shown on the right side of FIG. 2.

By introducing only a relatively small number of local time-steps, as represented by the three diamonds 106, 108, 110 between the initial time and final time for cells (grid blocks) 2 and 3, and using large global time-steps for all other cells, the solution technique is economized. Because the solution is fully implicit, the unknowns associated with the local time-steps will ultimately be solved fully coupled with the final time-step unknowns (i.e., all the open diamonds together).

Figure 3:
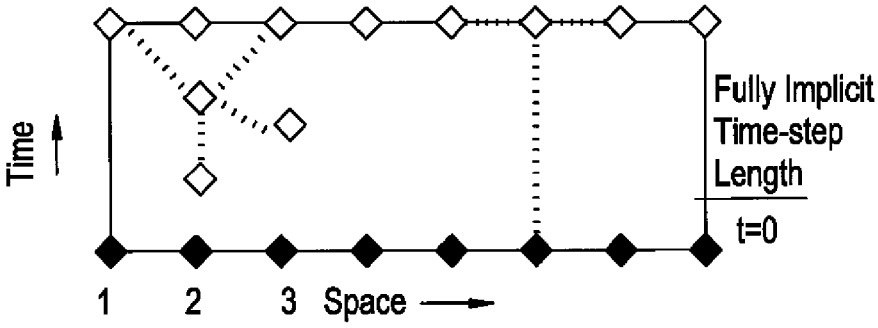
FIG. 3 is a schematic illustration showing the residual dependence of cells 2 and 6 on their respective neighboring (adjacent) cells and prior state, in accordance with the present disclosure.

Flows into and out of a grid block at a given time are complex and depend on locality in time as well as locality in space. For a given time-step, if there is any time overlap, then the flow will be calculated based on the solution of the adjacent cell most advanced in time (implicit flow assumption). This is illustrated in FIG. 3 by the dotted lines showing the residual dependence for the second cell at the second local time-step. This residual depends on the solution for cell 2 at the previous (first local) time-step and on flows to or from cells 1 and 3, including both time-steps of cell 3. Note that, away from the cells using local time-steps, the approximation is a standard fully implicit solution, as illustrated by the dotted lines showing the residual dependence associated with cell 6.

To determine the selection of the local time-steps, the physics of the problem being solved is considered. A single iteration (e.g., using Newton-Raphson) of the original, fully implicit problem is performed. This provides an approximation to the pressure field for all cells at the final time. Given the pressure field, one can calculate a potential for each phase, and for each phase one can order the grid blocks according to their potential, from highest to lowest. The potential of a phase within a grid block is a measure of that fluid's propensity to flow. Flow will occur from a region of higher potential towards a region of lower potential.

Figure 4:
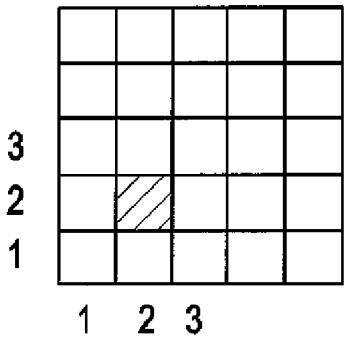
FIG. 4 is a schematic illustration of an example solution method in which cell (2, 2) has the highest potential, in accordance with the present disclosure.
Figure 5:
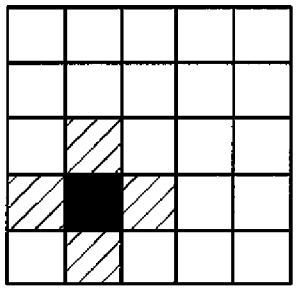
FIG. 5 is a schematic illustration of the example of FIG. 4 in which the flow equations representing the flow from cell (2, 2) into neighboring cells sharing a common face are being solved, in accordance with the present disclosure.
Figure 6:
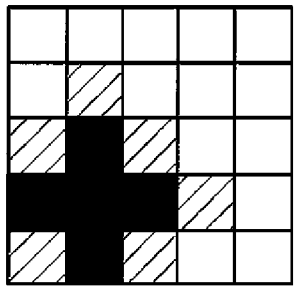
FIG. 6 is a schematic illustration of the example of FIG. 4 in which the flow equations representing the flow from cells (1, 2), (2, 3), (3, 2), and (2, 1) into respective neighboring cells sharing a common face are being solved, in accordance with the present disclosure.

If one starts at the highest potential grid block and solves the flow equations, one can ascertain an appropriate time-step sequence for the solution of that grid block. Given that solution, one can repeat the calculation for grid blocks downstream, eventually building up the required time-steps for all grid blocks. More specifically, the full conservation equations are solved on a local basis, assuming the upstream conditions are fixed. This process is illustrated in FIGS. 4, 5, and 6, where the highest potential is in grid block (2, 2) (see FIG. 4). Knowing the total flow into that cell (e.g., from an injection well), one can solve for the local pressure and saturations and the associated flows out of that cell. Once the flows out of cell (2, 2) are determined, one can calculate those parameters for cells (1, 2), (3, 2), (2, 1), and (2, 3) since one knows all the upstream flows (see FIG. 5). This process is repeated until the flow equations for all the cells are solved for (see FIG. 6).

Thus, time-step selection is determined using a local solution of the flow equations on a cell-by-cell basis, with the cells ordered from highest potential to lowest potential. In practice, for a given cell an initial full length time-step is attempted. If the local non-linear solver fails to find a solution, or the solution involves a saturation change greater than a user specified number (typically ~0.1), then the time-step is reduced. Eventually each cell will be solved using a sequence of time-steps that fit the above criteria. The time-step sequence may comprise shortened steps or may be a single fully implicit step. The determined time-step sequence is used to determine the unknown variables in the fully coupled solution. Once a suitable set of time-steps has been decided on, then the full system, including the local time-steps, may be solved in a traditional manner, such as using Newton-Raphson iteration.

The local solution procedure is repeated for each phase. Each phase will typically be ordered differently. The time-step sequence ultimately used for each grid block in the coupled solution will be the set that is the most restrictive (i.e., the smallest time-steps for each grid block). The local solution can be used for two purposes: (1) to select local time-steps for each cell; and (2) to provide a good approximation for the subsequent fully coupled iterations.

Figure 7:
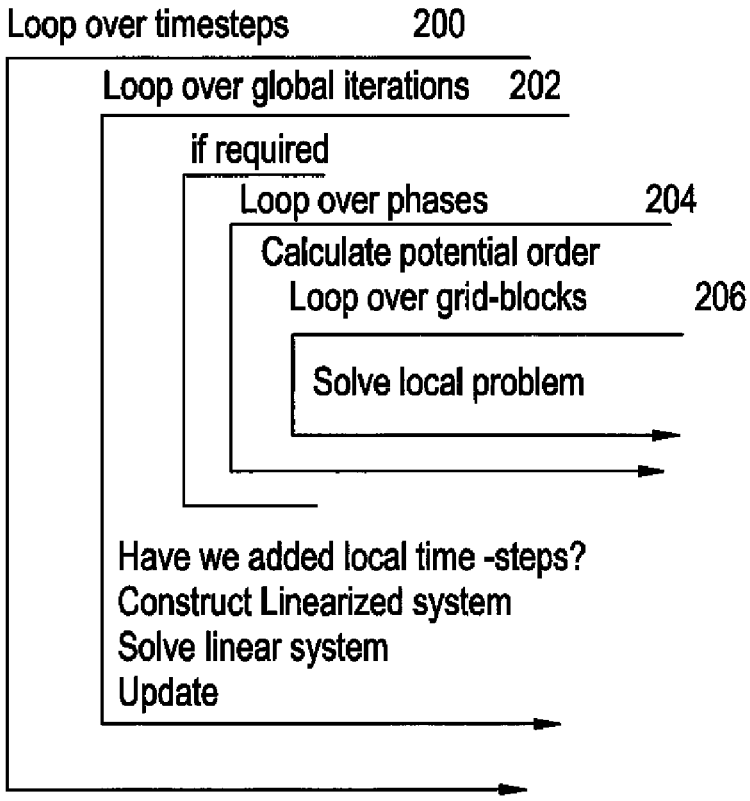
FIG. 7 is a flowchart showing an example embodiment, in accordance with the present disclosure.

An overview of the solution procedure is shown in FIG. 7. For each (global) time-step 200, the fully coupled non-linear problem is solved using a non-linear iteration loop 202. An iteration step starts by calculating the phase potentials and the associated flow order 204. For each phase, one loops over the grid blocks in potential order 206, solving the conservations equations locally to decide what time-steps are required for each grid block and to provide a reasonable approximation to the coupled solution. With that information, one can construct a linearized approximation to the fully coupled solution, solve the resulting system, and update the solution. When the local solution does not require additional local time-steps, then that part of the calculation is dropped and the scheme reduces to a standard Newton-Raphson iteration on the fully coupled system.

The benefit of such a scheme will depend on the problem being solved. The extra calculation of the local solution and the subsequent increase in the number of global unknowns may or may not be offset by the longer time-step. In a 3-dimensional problem, one might expect significant time-step benefit for a relatively small number of extra unknowns. For example, if the global problem has one million grid blocks, adding tens, or even hundreds, of local time-steps is computationally more efficient than solving the equations ten or twenty times for all one million grid blocks. Further, as the spatial resolution of the grid is reduced, a fully implicit scheme will typically require a proportionately smaller time-step, leading to a quadratic dependence on grid size. Using the disclosed method, the scaling behavior is significantly improved as the unknowns are only added locally in space.

Figure 8:
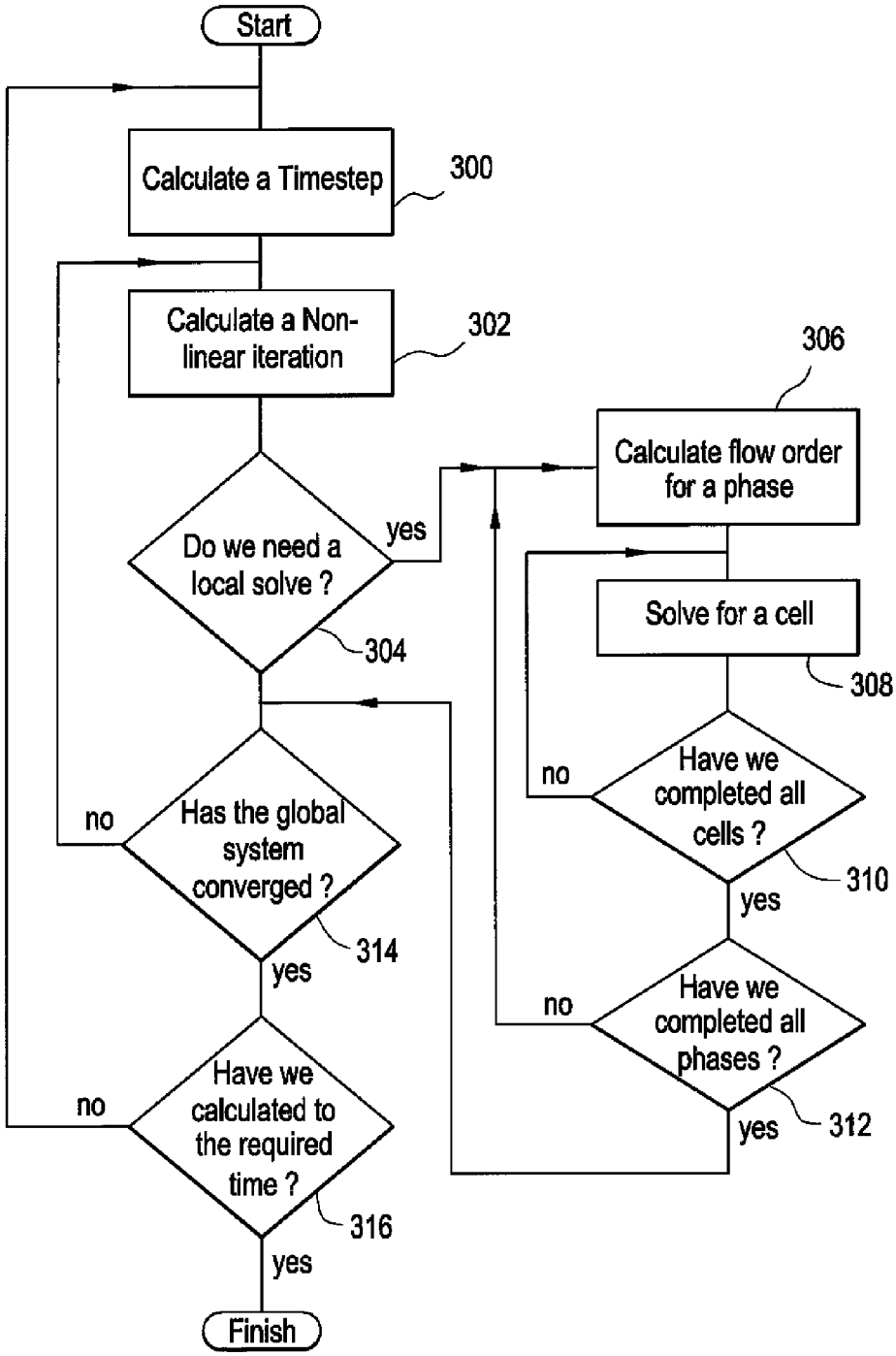
FIG. 8 is a alternative flowchart showing the example embodiment of FIG. 7.

An alternative illustration of the above solution procedure is provided by FIG. 8. FIG. 8 is a flowchart showing various steps of one embodiment of the solution procedure. A time-step is calculated (300) and a non-linear iteration is performed (302). An assessment is made as to whether a local solve is needed (304). If so, a flow order is determined for a particular phase (306) and the controlling equations are solved for a cell (308). Solving the controlling equations is repeated for each cell until all cells are completed (310). If there are additional phases, a new flow order is calculated for that phase and the controlling equations are solved for each cell until all cells of all phases are completed (312). If the global system has yet to converge, then the process is repeated (314), beginning with the non-linear iteration (302). If the global system has converged (314), then an assessment is made as to whether the calculations have extended to the required time (316). If so, the computed results are output, but if not, the entire process repeats, beginning with the calculation of a time-step (300).

Figure 9:
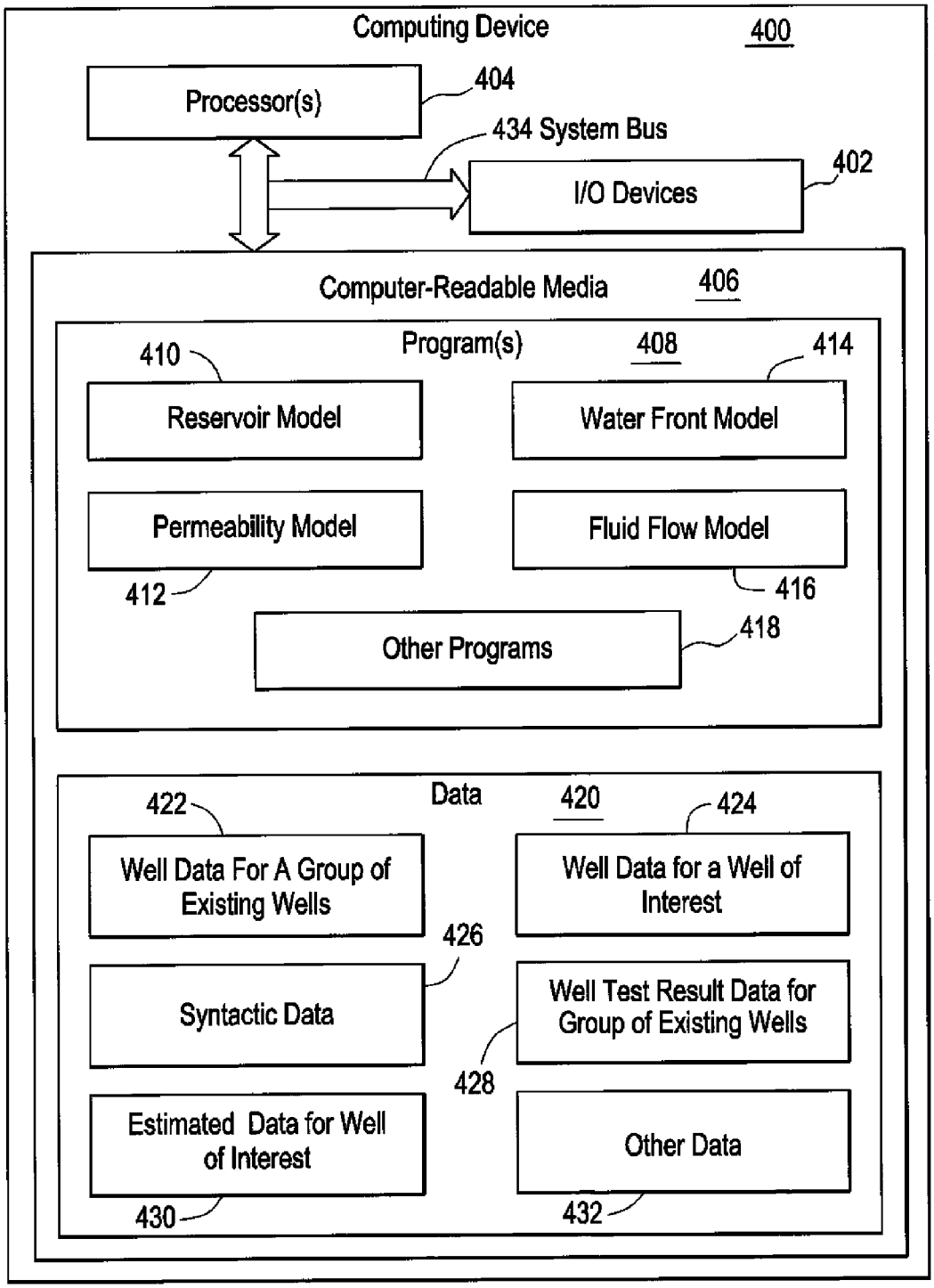
FIG. 9 illustrates an example computing device on which elements of fluid flow prediction may be implemented.

FIG. 9 shows an example computing device 400 suitable for implementing embodiments of fluid flow prediction. Computing device 400 can be implemented as any form of computing and/or electronic device. For example, computing device 400 can include a server, a desktop PC, a notebook or portable computer, a workstation, a mainframe computer, an Internet appliance, and so on. Computing device 400 includes input/output (I/O) devices 402, one or more processors 404, and computer readable media 406.

I/O devices 402 can include any device over which data and/or instructions can be transmitted or received by computing device 400. For example, 110 devices 402 can include one or more of an optical disk drive, a USB device, a keyboard, a touch screen, a monitor, a mouse, a digitizer, a scanner, a track ball, various cameras, motion detection devices, etc.

I/O devices 402 can also include one or more communication interface(s) implemented as any of one or more of a serial and/or parallel interface, a wireless interface, any type of network interface, a modem, a network interface card, or any other type of communication interface capable of connecting computing device 400 to a network or to another computing or electrical device.

Processor(s) 404 include microprocessors, controllers, and the like, configured to process various computer executable instructions controlling the operation of computing device 400. For example, processor(s) 404 can enable computing device 400 to communicate with other electronic and computing devices, and to process instructions and data in conjunction with programs 408 stored in computer-readable media 406.

Computer-readable media 406, can include one or more memory components including random access memory (RAM), non-volatile memory (e.g., any of one or more of a read-only memory (ROM), flash memory, EPROM, EEPROM, etc.), and a disk storage device. A disk storage device can include any type of magnetic or optical storage device, such as a hard disk drive, a recordable and/or rewriteable compact disc (CD), a DVD, a DVD+RW, and the like.

Computer-readable media 406 provides storage mechanisms to store various information, data and/or instructions such as software applications and any other types of information and data related to operational aspects of computing device 400. For example, programs 408 stored on computer-readable media 406 can include a reservoir model 410, a water front model 412, a fluid flow model 414, a permeability model 416, and other programs 418—such as an operating system and/or assorted application programs. Programs 408 can be executed on processor(s) 404.

Computer-readable media 406 can also include data 420. For example, as illustrated in FIG. 9, data 420 residing on computer-readable media 406 can include well data for a group of existing wells 422, well data for a well of interest 424, syntactic data 426, well test result data for the group of existing wells 428, estimated data from the well of interest 430 and other data 432 (including intermediate and final data created through use of one or more of programs 408).

Any of programs 408 and data 420 can reside wholly or partially on any of a variety of media types found in computer-readable media 406. For example portions of reservoir model 410 can reside at different times in random access memory (RAM), read only memory (ROM), optical storage discs (such as CDs and DVDs), floppy disks, optical devices, flash devices, etc.

A system bus 434 can couple one or more of the processors 404, I/O devices 402, and computer-readable media 406 to each other. System bus 434 can include one or more of any of several types of bus structures, including a memory bus or memory controller, a peripheral bus, an accelerated graphics port, and a processor or local bus using any of a variety of bus architectures. By way of example, such architectures can include an industry standard architecture (ISA) bus, a micro channel architecture (MCA) bus, an enhanced ISA (EISA) bus, a video electronics standards association (VESA) local bus, and a peripheral component interconnects (PCI) bus also known as a mezzanine bus, and so on.

While the disclosed method has been discussed in terms of its applicability to fluid flow problems, it is also applicable to other physical phenomena. Examples of two such phenomena are thermal modeling and the explicit modeling of hydraulic fractures. In the thermal case, current technologies take days of computer time to solve relatively small problems due to time-step limitations. Likewise, when hydraulic fractures are discretized, the resulting tiny grid block volumes cause considerable challenges to all current simulators. The present method can be adapted for use with such diverse phenomena and such applications are considered within the scope of the present disclosure.

While the present subject matter has been described with respect to a limited number of embodiments, those skilled in the art, having benefit of this disclosure, will appreciate that other embodiments can be envisioned that do not depart from the contemplated scope of the disclosed subject matter. Accordingly, the scope of the disclosed subject matter shall be limited only by the attached claims.

What is claimed is:

1. A method to determine fluid flow in a subsurface reservoir, comprising:

dividing the reservoir into discrete volume elements;

determining, for one or more fluid phases comprising the fluid, the potential for each volume element;

ordering, for one or more of the fluid phases, the volume elements according to their potentials;

determining local, fully coupled time-step sequences using local conservation solutions based on the potential ordering of one or more of the fluid phases; and determining the fluid flow using a global conservation solution based on the local, fully coupled time-step sequences wherein the determining the fluid flow comprises computing, using a computing device, a fully coupled solution using unknowns resulting from refined local discretizations in time associated with the local time-step sequences along with unknowns associated with a final time-step.

2. The method of claim 1, further comprising injecting fluid at a known rate into a particular volume element or particular volume elements.

3. The method of claim 1, wherein the fluid phases comprise oil, water, or gas.

4. The method of claim 1, wherein the determining the potential comprises using an approximation to a pressure field.

5. The method of claim 1, wherein the ordering is from highest potential to lowest potential.

6. The method of claim 5, wherein the determining the time-step sequences comprises:

solving the flow equations for the volume element having the highest potential;

ascertaining an appropriate time-step sequence for the solution of that highest potential volume element to be one of the time-step sequences;

solving the flow equations for all volume elements directly downstream of the highest potential volume element, using the previously computed solution;

ascertaining the time-step sequences for those downstream volume elements; and repeating the solving the flow equations for all directly downstream volume elements and the ascertaining the time-step sequences for those downstream volume elements until the flow equations for all the volume elements are solved and the time-step sequences for all the volume elements are ascertained.

7. The method of claim 6, wherein using the previously computed solution comprises assuming the upstream conditions are fixed.

8. The method of claim 6, wherein the determining the time-step sequences is repeated for each fluid phase.

9. The method of claim 1, wherein the determining the time-step sequences comprises using a local conservation solution on a volume element-by-volume element basis, with the volume elements ordered from highest potential to lowest potential for one or more of the fluid phases.

10. The method of claim 1, wherein the determining the fluid flow uses the most restrictive set of determined time-step sequences.

11. The method of claim 1, wherein the determining the fluid flow comprises using local solutions of adjacent volumes elements most advanced in time.

12. A method to manage a subsurface reservoir, comprising:

determining fluid flow in the subsurface reservoir by:

dividing the reservoir into discrete volume elements;

determining, for one or more fluid phases comprising the fluid, the potential for each volume element;

ordering, for one or more of the fluid phases, the volume elements according to their potentials;

determining local, fully coupled time-step sequences using local conservation solutions based on the potential ordering of one or more of the fluid phases;

determining the fluid flow using a global conservation solution based on the local, fully coupled time-step sequences wherein the determining the fluid flow comprises computing, using a computing device, a fully coupled solution using unknowns resulting from refined local discretizations in time associated with local time-step sequences along with unknowns associated with a final time-step; and determining one or more injection and/or production sites based on the determined fluid flow.

13. The method of claim 12, further comprising determining a fluid type for injection into the reservoir based on the determined fluid flow.

14. The method of claim 12, further comprising determining a flow rate for fluid to be injected into the reservoir based on the determined fluid flow.

15. The method of claim 12, further comprising a determining a flow capacity for one or more of the production sites based on the determined fluid flow.

16. The method of claim 12, further comprising estimating the cost recovery period based on the determined fluid flow.

17. A system to determine fluid flow in a subsurface reservoir, comprising:

a computer system comprising a central processing unit, an input device, and an output device;

input data that can be read by the input device, the input data comprising known values of state variables characterizing the fluid flow at some time;

a computer program that can be run on the central processing unit to:

divide the reservoir into discrete volume elements;

determine, for one or more fluid phases comprising the fluid, the potential for each volume element;

order, for one or more of the fluid phases, the volume elements according to their potentials;

determine local, fully coupled time-step sequences using local conservation solutions based on the potential ordering of one or more of the fluid phases;

determine the fluid flow using a global conservation solution based on the local, fully coupled time-step sequences by computing a fully coupled solution using unknowns resulting from refined local discretizations in time associated with local time-step sequences along with unknowns associated with a final time-step; and output the determined fluid flow to the output device.

18. The system of claim 17, wherein the input data includes the flow rate of an injected fluid into an injection well.

19. The system of claim 17, wherein the output device is a printer, a plotter, a monitor, or a memory device.

* * * * *